US010156019B2

(12) United States Patent
Arvin et al.

(10) Patent No.: US 10,156,019 B2
(45) Date of Patent: Dec. 18, 2018

(54) ELECTRODEPOSITION SYSTEM AND METHOD INCORPORATING AN ANODE HAVING A BACK SIDE CAPACITIVE ELEMENT

(71) Applicants: International Business Machines Corporation, Armonk, NY (US); Ancosys GmbH, Pliezhausen (DE)

(72) Inventors: Charles L. Arvin, Poughkeepsie, NY (US); Jürg Stahl, Winterthur (CH)

(73) Assignees: International Business Machines Corporation, Armonk, NY (US); Ancosys GmbH, Pliezhausen (DE)

( * ) Notice: Subject to any disclaimer, the term of this patent is extended or adjusted under 35 U.S.C. 154(b) by 0 days.

(21) Appl. No.: 15/802,619

(22) Filed: Nov. 3, 2017

(65) Prior Publication Data

US 2018/0051385 A1 Feb. 22, 2018

Related U.S. Application Data

(60) Continuation of application No. 14/831,252, filed on Aug. 20, 2015, now Pat. No. 9,863,051, which is a (Continued)

(51) Int. Cl.
*C25D 3/56* (2006.01)
*C25D 21/00* (2006.01)

(Continued)

(52) U.S. Cl.
CPC ..... *C25D 3/56* (2013.01); *C23F 13/005* (2013.01); *C25D 3/30* (2013.01); *C25D 3/46* (2013.01);

(Continued)

(58) Field of Classification Search
CPC ... C25D 3/30; C25D 3/46; C25D 3/56; C25D 3/64; C25D 13/005; C25D 17/00;

(Continued)

(56) References Cited

U.S. PATENT DOCUMENTS 1,313,246 A 8/1919 Antisell
4,000,046 A 12/1976 Weaver (Continued)

FOREIGN PATENT DOCUMENTS

JP 2013-166981 8/2013

OTHER PUBLICATIONS

Lou et al., "Electroplating", Encyclopedia of Chemical Processing DOI: 10.1081/E-ECHIP-120007747, 2006, pp. 1-10.

(Continued)

*Primary Examiner* — Ciel P Thomas
(74) *Attorney, Agent, or Firm* — Gibb & Riley, LLC; Steven J. Meyers, Esq.

(57) ABSTRACT

Disclosed are an electrodeposition system and method with an anode assembly comprising a capacitor comprising a first conductive plate (i.e., an anode) with a frontside having a surface exposed to a plating solution, a second conductive plate on a backside of the first conductive plate, and a dielectric layer between the two conductive plates. During a non-plating mode, a power source, having positive and negative terminals connected to the first and second conductive plates, respectively, is turned on, thereby polarizing the first conductive plate (i.e., the anode) relative to the second conductive plate to prevent degradation of the anode and/or plating solution. During an active plating mode, another power source, having positive and negative terminals connected to the first conductive plate (i.e., the anode)

(Continued)

and a cathode, respectively, is turned on, thereby polarizing the anode relative to the cathode in order to deposit a plated layer on a workpiece.

19 Claims, 5 Drawing Sheets

Related U.S. Application Data division of application No. 14/315,390, filed on Jun. 26, 2014, now Pat. No. 9,481,940.

(51) Int. Cl.

| | |
|---|---|
| ***C23F 13/00*** | (2006.01) |
| ***C25D 3/30*** | (2006.01) |
| ***C25D 3/46*** | (2006.01) |
| ***C25D 21/12*** | (2006.01) |
| ***C25D 3/60*** | (2006.01) |
| ***C25D 3/64*** | (2006.01) |
| ***C25D 17/10*** | (2006.01) |

(52) U.S. Cl.
CPC ..... *C25D 3/60* (2013.01); *C25D 3/64* (2013.01); *C25D 21/00* (2013.01); *C25D 21/12* (2013.01); *C25D 17/10* (2013.01)

(58) Field of Classification Search
CPC .... C25D 17/004; C25D 17/005; C25D 17/10; C25D 17/12; C25D 21/00; C25D 21/12; C23F 13/005
See application file for complete search history.

(56) References Cited

U.S. PATENT DOCUMENTS

| | | | | |
|---|---|---|---|---|
| 4,290,861 | A | 9/1981 | Gaerttner et al. | |
| 4,459,183 | A | 7/1984 | Brady et al. | |
| 8,177,944 | B2 | 5/2012 | Saito et al. | |
| 8,674,476 | B2 | 3/2014 | Basker et al. | |
| 9,481,940 | B2 * | 11/2016 | Arvin ..... | C25D 3/56 |
| 2007/0289871 | A1 | 12/2007 | Hafezi et al. | |
| 2009/0145765 | A1 | 6/2009 | Abys et al. | |
| 2012/0043216 | A1 | 2/2012 | Arvin et al. | |
| 2012/0298502 | A1 | 11/2012 | Papapanayiotou et al. | |
| 2012/0298504 | A1 | 11/2012 | Guamaccia et al. | |

OTHER PUBLICATIONS

U.S. Appl. No. 14/315,390, Office Action Communication dated Apr. 1, 2015, pp. 1-6.
U.S. Appl. No. 14/315,390, Office Action Communication dated Aug. 13, 2015, pp. 1-11.
U.S. Appl. No. 14/315,390, Office Action Communication dated Mar. 9, 2016 pp. 1-15.
U.S. Appl. No. 14/315,390, Notice of Allowance dated Jul. 14, 2016, pp. 1-12.
U.S. Appl. No. 14/831,252, Notice of Allowance dated Aug. 30, 2017, pp. 1-12.

* cited by examiner

ELECTRODEPOSITION SYSTEM AND METHOD INCORPORATING AN ANODE HAVING A BACK SIDE CAPACITIVE ELEMENT

CROSS-REFERENCE TO RELATED APPLICATIONS

The present application claims the benefit under 35 U.S.C. § 120 as a continuation of U.S. patent application Ser. No. 14/831,252, filed on Aug. 20, 2015, now U.S. Pat. No. 9,863,051, issued on Jan. 9, 2018, which is a divisional of U.S. patent application Ser. No. 14/315,390, filed on Jun. 26, 2014, now U.S. Pat. No. 9,481,940, issued on Nov. 1, 2016, the entire teachings of which are incorporated herein by reference.

BACKGROUND

The present invention relates to electrodeposition and, more particularly, to an electrodeposition system and method that incorporate an anode having a backside capacitive element in order to minimize anode and/or plating solution degradation during non-plating periods (i.e., during idle periods before or after active plating).

Generally, electrodeposition (also referred to herein as electroplating) is a process in which plating material(s) and, particularly, one or more different metals are deposited onto a workpiece. Specifically, during electrodeposition, a plating solution (i.e., a plating bath) is contained within a plating container and plating material(s) is/are dissolved in the plating solution as stabilized metal species (i.e., as metal ions). A workpiece to be plated (i.e., an object to be plated, an article to be plated, etc.) and, particularly, a cathode and at least one anode are placed into the plating solution. The cathode and anode can be electrically connected to the negative and positive terminals, respectively, of a power supply in order to create an electric circuit. The power supply can subsequently be turned on so that electric current flows through the electric circuit from the anode to the cathode by means of ion transport through the plating solution. As a result of this current flow, electron transfer can occur at the cathode and anode such that the plating material(s) take up electrons at the cathode, thereby causing a layer of metal or a layer of a metal alloy (e.g., depending upon whether a single or multiple metal species are dissolved in the plating solution) to deposit thereon. The metal specie(s) in the plating solution can be replenished by the anode(s), if/when the anode(s) are soluble (i.e., if/when the anode(s) comprise soluble metal(s)) and the electric current causes the soluble metal(s) to dissolve in the plating solution). Additionally or alternatively, the metal specie(s) can be added directly to the plating solution.

Unfortunately, during non-plating periods (e.g., when the cathode is disconnected from the power source and removed from the plating solution and when the anode is exposed to the plating solution), any charged surface of the anode exposed to the plating solution can potentially cause unwanted reactions that result in anode degradation and/or plating solution degradation. Therefore, there is a need in the art for an electrodeposition system and method that minimize anode and/or plating solution degradation during such non-plating periods.

SUMMARY

In view of the foregoing, disclosed herein are an electrodeposition system and method that use a novel anode having a backside capacitive element in order to minimize anode and/or plating solution degradation when the anode is exposed to a plating solution during a non-plating period (i.e., during an idle period). Specifically, in the electrodeposition system and method disclosed herein, an anode assembly can comprise a capacitor comprising a first conductive plate (and, particularly, an anode), which has a frontside with a surface exposed to a plating solution and a backside opposite the frontside. The capacitor can further comprise a second conductive plate on the backside of the first conductive plate and a dielectric layer between the first conductive plate and the second conductive plate. During a non-plating mode, a first power source, which has positive and negative terminals electrically connected to the first and second conductive plates, respectively, can be selectively turned on, thereby polarizing the first conductive plate relative to the second conductive plate in order to prevent degradation of the surface of the first conductive plate, which is exposed to the plating solution, and/or to prevent degradation of the plating solution. During an active plating mode, the first power source can be selectively turned off and a second power source, which has positive and negative terminals electrically connected to the first conductive plate (i.e., the anode) and a cathode, respectively, can be selectively turned on, thereby polarizing the first conductive plate (i.e., the anode) relative to the cathode in order to deposit a plated layer on a workpiece, which is exposed to the plating solution at the cathode.

More specifically, disclosed herein is an electrodeposition system. The electrodeposition system can comprise a container for containing a plating solution.

The electrodeposition system can further comprise an anode assembly and a first power source. The anode assembly can be removably placed in the plating solution within the container and can comprise a capacitor. This capacitor can comprise a first conductive plate and, particularly, an anode. The first conductive plate (i.e., the anode) can have a frontside, which has a surface exposed to the plating solution, and a backside opposite the frontside. The capacitor can further comprise a second conductive plate adjacent to the backside of the first conductive plate and a dielectric layer between the first conductive plate and the second conductive plate. The first power source can comprise a first positive terminal electrically connected to the first conductive plate and a first negative terminal electrically connected to the second conductive plate. During a non-plating mode and, particularly, when the surface of the first conductive plate (i.e., the anode) that is exposed to the plating solution is not polarized relative to a cathode for plating purposes, the first power source can supply a first operating current to the capacitor in order to polarize the first conductive plate (i.e., the anode) relative to the second conductive plate and, thereby prevent anode and/or plating solution degradation.

The electrodeposition system can further comprise a cathode assembly and a second power source. The cathode assembly can be removably placed in the plating solution in the container and can comprise a workpiece and, particularly, a cathode, which is exposed to the plating solution. The second power source can comprise a second positive terminal electrically connected to the first conductive plate (i.e., the anode) and a second negative terminal electrically connected to the workpiece (i.e., the cathode), thereby forming an electric circuit. During an active plating mode, the second power source can supply a second operating current to the electric circuit in order to polarize the first conductive plate (i.e., the anode) relative to the workpiece (i.e., the cathode)

and, thereby form a plated layer on the workpiece, which as mentioned above is exposed to the plating solution at the cathode assembly.

For example, such an electrodeposition system can comprise a container for containing a plating solution and, particularly, a methyl sulfonic acid (MSA)-based plating solution. The MSA-based plating solution can comprise water and, dissolved in the water, methyl sulfonic acid (MSA), tin ions and silver ions. Such an electrodeposition system can further comprise an anode assembly and a first power source. The anode assembly can be removably placed in the plating solution within the container and can comprise a capacitor. This capacitor can comprise a first conductive plate and, particularly, a soluble anode comprising a soluble metal plate such as a tin plate. The first conductive plate can have a frontside, which has a surface exposed to the MSA-based plating solution, and a backside opposite the frontside. The capacitor can further comprise a second conductive plate adjacent to the backside of the first conductive plate and a dielectric layer between the first conductive plate and the second conductive plate. The first power source can comprise a first positive terminal electrically connected to the first conductive plate (i.e., to the soluble anode) and a first negative terminal electrically connected to the second conductive plate. During a non-plating mode and, particularly, when the surface of the first conductive plate (i.e., the surface of the soluble anode) that is exposed to the MSA-based plating solution is not polarized relative to a cathode for plating purposes, the first power source can supply a first operating current to the capacitor in order to polarize the first conductive plate (i.e., the soluble anode) relative to the second conductive plate and, thereby prevent anode and/or plating solution degradation.

Such an electrodeposition system can further comprise a cathode assembly and a second power source. The cathode assembly can be removably placed in the MSA-based plating solution in the container and can comprise a workpiece and, particularly, a cathode, which is exposed to the MSA-based plating solution. The second power source can comprise a second positive terminal electrically connected to the first conductive plate (i.e., the soluble anode) and a second negative terminal electrically connected to the workpiece (i.e., the cathode), thereby forming an electric circuit. During an active plating mode, the second power source can supply a second operating current to the electric circuit in order to polarize the first conductive plate (i.e., the soluble anode) relative to the workpiece (i.e., the cathode) and, thereby form a plated layer and, particularly, a tin-silver (SnAg) plated layer on the workpiece, which as mentioned above is exposed to the MSA-based plating solution at the cathode assembly.

Also disclosed herein is an electrodeposition method. The electrodeposition method can comprise providing a container for containing a plating solution.

The electrodeposition method can further comprise providing an anode assembly and a first power source. The anode assembly can be removably placed in the plating solution within the container and can comprise a capacitor. This capacitor can comprise a first conductive plate and, particularly, an anode. The first conductive plate (i.e., the anode) can have a frontside, which has a surface exposed to the plating solution, and a backside opposite the frontside. The capacitor can further comprise a second conductive plate adjacent to the backside of the first conductive plate and a dielectric layer between the first conductive plate and the second conductive plate. The first conductive plate (i.e., the anode) can be electrically connected to a first positive terminal of the first power source and the second conductive plate can be electrically connected to a first negative terminal of the first power source. The electrodepositing method can further comprise, during a non-plating mode and, particularly, when the surface of the first conductive plate (i.e., the anode) that is exposed to the plating solution is not polarized relative to a cathode for plating purposes, selectively turning on the first power source in order to supply a first operating current to the capacitor so as to polarize the first conductive plate (i.e., the anode) relative to the second conductive plate and, thereby prevent anode and/or plating solution degradation.

The electrodeposition method can further comprise providing a cathode assembly and a second power source. The cathode assembly can be removably placed in the plating solution in the container and can comprise a workpiece and, particularly, a cathode, which is exposed to the plating solution. The first conductive plate (i.e., the anode) can be electrically connected to a second positive terminal of the second power source and the workpiece (i.e., the cathode) can be electrically connected to a second negative terminal of the second power source, thereby forming an electric circuit. The electrodeposition method can further comprise, during an active plating mode, selectively turning off the first power source and selectively turning on the second power source in order to supply a second operating current to the electric circuit so as to polarize the first conductive plate (i.e., the anode) relative to the workpiece (i.e., the cathode) and, thereby form a plated layer on the workpiece, which as mentioned above is exposed to the plating solution at the cathode assembly.

For example, such an electrodeposition method can comprise providing a container for containing a plating solution and, particularly, a methyl sulfonic acid (MSA)-based plating solution. The MSA-based plating solution can comprise water and, dissolved in the water, methyl sulfonic acid (MSA), tin ions and silver ions. Such an electrodeposition method can further comprise providing an anode assembly and a first power source. The anode assembly can be removably placed in the plating solution within the container and can comprise a capacitor. This capacitor can comprise a first conductive plate and, particularly, a soluble anode comprising a soluble metal plate such as a tin plate. The first conductive plate can have a frontside, which has a surface exposed to the MSA-based plating solution, and a backside opposite the frontside. The capacitor can further comprise a second conductive plate adjacent to the backside of the first conductive plate and a dielectric layer between the first conductive plate and the second conductive plate. The first conductive plate (i.e., the soluble anode) can be electrically connected to a first positive terminal of the first power source and the second conductive plate can be electrically connected to a first negative terminal of the first power source. This electrodeposition method can further comprise, during a non-plating mode and, particularly, when the surface of the first conductive plate (i.e., the surface of the soluble anode) that is exposed to the MSA-based plating solution is not polarized relative to a cathode for plating purposes, selectively turning on the first power source in order to supply a first operating current to the capacitor so as to polarize the first conductive plate (i.e., the soluble anode) relative to the second conductive plate and, thereby prevent anode and/or plating solution degradation.

Such an electrodeposition method can further comprise providing a cathode assembly and a second power source. The cathode assembly can be removably placed in the MSA-based plating solution in the container and can comprise a workpiece and, particularly, a cathode, which is exposed to the MSA-based plating solution. The first conductive plate (i.e., the soluble anode) can be electrically connected to a second positive terminal of the second power source and the workpiece (i.e., the cathode) can be electrically connected to a second negative terminal of the second power source, thereby forming an electric circuit. The electrodeposition method can further comprise, during an active plating mode, selectively turning off the first power source and selectively turning on the second power source in order to supply a second operating current to the electric circuit so as to polarize the first conductive plate (i.e., the soluble anode) relative to the workpiece (i.e., the cathode) and, thereby form a plated layer and, particularly, a tin-silver (SnAg) plated layer on the workpiece, which as mentioned above is exposed to the MSA-based plating solution at the cathode assembly.

BRIEF DESCRIPTION OF THE SEVERAL VIEWS OF THE DRAWINGS

The embodiments herein will be better understood from the following detailed description with reference to the drawings, which are not necessarily drawn to scale and in which.

DETAILED DESCRIPTION

Figure 1:
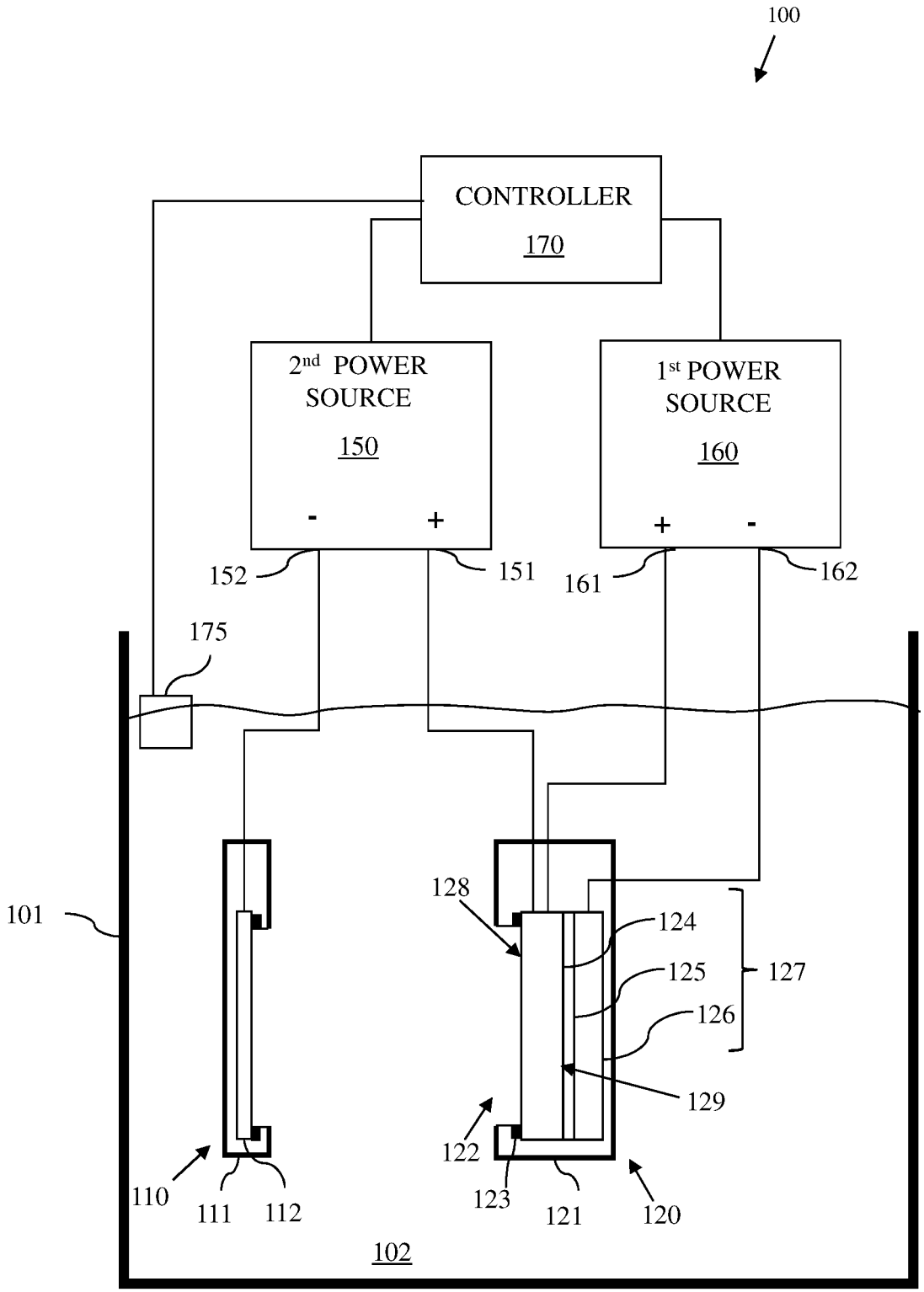
FIG. 1 is a schematic diagram illustrating an electrodeposition system.

As mentioned above, electrodeposition (also referred to herein as electroplating) is a process in which plating material(s) and, particularly, one or more different metals are deposited onto a workpiece. Specifically, during electrodeposition, a plating solution (i.e., a plating bath) is contained within a plating container and plating material(s) is/are dissolved in the plating solution as stabilized metal species (i.e., as metal ions). A workpiece to be plated (i.e., an object to be plated, an article to be plated, etc.) and, particularly, a cathode and at least one anode are placed into the plating solution. The cathode and anode can be electrically connected to the negative and positive terminals, respectively, of a power supply in order to create an electric circuit. The power supply can subsequently be turned on so that electric current flows through the electric circuit from the anode to the cathode by means of ion transport through the plating solution. As a result of this current flow, electron transfer can occur at the cathode and anode such that the plating material(s) take up electrons at the cathode, thereby causing a layer of metal or a layer of a metal alloy (e.g., depending upon whether a single or multiple metal species are dissolved in the plating solution) to deposit thereon. The metal specie(s) in the plating solution can be replenished by the anode(s), if/when the anode(s) are soluble (i.e., if/when the anode(s) comprise soluble metal(s)) and the electric current causes the soluble metal(s) to dissolve in the plating solution). Additionally or alternatively, the metal specie(s) can be added directly to the plating solution.

Unfortunately, during non-plating periods (e.g., when the cathode is disconnected from the power source and removed from the plating solution and when the anode is exposed to the plating solution), any charged surface of the anode exposed to the plating solution can potentially cause unwanted reactions that result in anode degradation and/or plating solution degradation.

For example, electrodeposition is often used to deposit tin-silver (SnAg) solder for controlled collapsed chip connections (i.e., C4 connections) on integrated circuit chips; however, during non-plating periods, unwanted reactions in the plating container can result in degradation of any soluble or insoluble anode(s) used and/or degradation of the plating solution, which can lead to non-uniform plating and, particularly, skip plating. Those skilled in the art will recognize that the term skip plating refers to C4 solder plating that is non-uniform such that either no solder or a relatively low volume of solder is deposited for some of the C4 connections on an integrated circuit chip.

Specifically, one technique for electrodeposition of SnAg solder uses a methyl sulfonic acid (MSA)-based plating solution with silver ions (Ag+ ions) and tin ions ($Sn^{2+}$ ions) dissolved therein. A soluble tin (Sn) anode can further be used to replenish the tin ions ($Sn^{2+}$ ions) in the plating solution. However, during a non-plating period (e.g., when the cathode is disconnected from the power source and removed from the plating solution and the Sn anode remains exposed to the plating solution), a double layer can be created at the surface of the Sn anode and can cause the Ag+ ions in the plating solution to plate onto the Sn anode (i.e., can cause unwanted removal of the Ag+ ions from the plating solution), thereby degrading the composition of the plating solution and, particularly, reducing the silver (AO composition in the plating solution. Low Ag composition can cause undesirable and/or non-uniform electroplating of a SnAg layer during subsequent active plating.

Another technique for electrodeposition of SnAg solder similarly uses a methyl sulfonic acid (MSA)-based plating solution with silver ions (Ag+ ions) and tin ions ($Sn^{2+}$ ions) dissolved therein. In this case, an insoluble anode (e.g., a platinum (Pt) catalyst-coated titanium (Ti) anode) can be used and the tin ions ($Sn^{2+}$ ions) in the plating solution can be replenished by adding a tin (Sn) salt or a tin (Sn) concentrate (which comprises Sn salt previously dissolved in water or an MSA solution) to the plating solution. While this technique avoids silver (Ag) plating on the insoluble anode, using Sn salts and, particularly, using Sn concentrates to replenish the $Sn^{2+}$ ions in the plating solution is relatively expensive because of limited commercial availability of ultra low alpha Sn concentrate. Additionally, degradation of the anode with time will cause the platinum (Pt) to be removed from the surface exposing the titanium (Ti) material below the coating. During non-plating periods (e.g., when the cathode is disconnected from the power source and removed from the plating solution and the anode remains exposed to the plating solution), a double layer can be created at the exposed Ti surface of the anode causing titanium ions ($Ti^{4+}$ ions) to dissolve into the MSA-based plating solution and tin ions ($Sn^{2+}$ ions) from the MSA-based plating solution to deposit onto the anode, thereby forming a $SnO_2$/Pt catalyst-coated Ti anode, which can readily degrade organics in the MSA-based plating solution and lead to skip plating.

Another technique for electrodeposition of SnAg solder similarly uses a methyl sulfonic acid (MSA)-based plating solution with silver ions (Ag+ ions) and tin ions ($Sn^{2+}$ ions) dissolved therein. In this case, a corrosion-resistant insoluble anode (e.g., an Alkaline earth metal anode, an austenitic-type stainless steel anode or a graphite anode) can be used and the tin ions ($Sn^{2+}$ ions) in the plating solution can be replenished by adding a tin (Sn) salt or a tin (Sn) concentrate (which comprises Sn salt previously dissolved in water or an MSA solution) to the plating solution. While this technique avoids silver (Ag) plating on the corrosion-resistant anode, it is cost-prohibitive due to the high costs associated with both the use of a corrosion-resistant anode and the use of Sn salts and, particularly, Sn concentrates to replenish the $Sn^{2+}$ ions in the plating solution.

In view of the foregoing, disclosed herein are an electrodeposition system and method that use a novel anode having a backside capacitive element in order to minimize anode and/or plating solution degradation when the anode is exposed to a plating solution during a non-plating period (i.e., during an idle period). Specifically, in the electrodeposition system and method disclosed herein, an anode assembly can comprise a capacitor comprising a first conductive plate (and, particularly, an anode), which has a frontside with a surface exposed to a plating solution and a backside opposite the frontside. The capacitor can further comprise a second conductive plate on the backside of the first conductive plate and a dielectric layer between the first conductive plate and the second conductive plate. During a non-plating mode, a first power source, which has positive and negative terminals electrically connected to the first and second conductive plates, respectively, can be selectively turned on, thereby polarizing the first conductive plate relative to the second conductive plate in order to prevent degradation of the surface of the first conductive plate, which is exposed to the plating solution, and/or to prevent degradation of the plating solution. During an active plating mode, the first power source can be selectively turned off and a second power source, which has positive and negative terminals electrically connected to the first conductive plate (i.e., the anode) and a cathode, respectively, can be selectively turned on, thereby polarizing the first conductive plate (i.e., the anode) relative to the cathode in order to deposit a plated layer on a workpiece, which is exposed to the plating solution at the cathode.

More specifically, referring to FIG. 1, disclosed herein is an electrodeposition system 100. For purposes of illustration, this electrodeposition system 100 is described below as a tin-silver (SnAg) electrodeposition system for use in depositing a SnAg plated layer on a workpiece (i.e., an article or object to be plated). Those skilled in the art will recognize that SnAg plated layers are often used as solder for controlled collapsed chip connections (i.e., C4 connections) on integrated circuit chips. It should, however, be understood that the electrodeposition system 100 could, alternatively, be used to deposit any other type of plated layer on a workpiece. That is, the electrodeposition system 100 could alternatively be used to deposit a plated layer comprising one or more of a variety of different metals including, but are not limited to, tin (Sn), silver (Ag), nickel (Ni), cobalt (Co), lead (Pb), copper (Cu), palladium (Pd), gold (Au) or their various alloys.

In any case, the electrodeposition system 100 can comprise a container 101 (i.e., a reservoir, a tub, etc.) for containing a plating solution 102. For purposes of this disclosure, a plating solution comprises at least a solvent (e.g., water) and a substance (e.g., an acid or base) that is dissolved in the solvent and that provides ionic conductivity. The plating solution 102 can comprise one or more organic additive(s) (also referred to herein as organics), such as complexers, charge carriers, levelers, brighteners, and/or wetters, dissolved in the solvent. The plating solution 102 can also comprise one or more different types of plating material(s), which are dissolved in the solvent as stabilized metal species (i.e., as metal ions). The metal ions can be dissolved in the plating solution 102 from metal salt(s) or from metal concentrate(s) (which are metal salt(s) previously dissolved in the same solvent used in the plating solution) and/or from soluble anode(s) used during an active plating mode, as discussed in greater detail below.

In a SnAg electrodeposition system, this plating solution 102 can comprise, for example, a methyl sulfonic acid (MSA)-based plating solution. Such an MSA-based plating solution can comprise a solvent and, particularly, water. Methyl sulfonic acid (MSA) can be dissolved in the water to provide ionic conductivity. Additionally, one or more organic additive(s) (e.g., complexers, charge carriers, levelers, brighteners and/or wetters), tin ions ($Sn^{2+}$ ions), and silver ions (Ag+ ions) can be dissolved in the water. The $Sn^{2+}$ ions can be dissolved in the water from a tin (Sn) salt or from a tin (Sn) concentrate and/or can be dissolved in the water, during an active plating mode, from a soluble tin (Sn) anode (e.g., if such an anode is used (see detailed discussion below regarding anode composition)). The Ag+ ions can be dissolved in the water from a silver (Ag) salt or a silver (Ag) concentrate (which comprises Ag salt previously dissolved in water or an MSA solution). Alternatively, in a SnAg electrodeposition system, the plating solution 102 can comprise a phosphonate-based plating solution, a pyrophosphate-based plating solution, or any other suitable plating solution.

The electrodeposition system 100 can further comprise an anode assembly 120 and a cathode assembly 110, a first power source 160, and a second power source 150.

The anode assembly 120 can be removably placed within the plating solution 102 in the container 101 and can comprise a capacitor 127 and a first holder 121 for holding the capacitor 127 in the plating solution 102 within the container 101. The capacitor 127 can comprise a first conductive plate 124 and, particularly, an anode. The first conductive plate 124 (i.e., the anode) can have a frontside 128 and a backside 129 opposite the frontside 128. This first conductive plate 124 can comprise a soluble metal plate such that the anode is a soluble anode. Alternatively, the first conductive plate 124 can comprise an insoluble metal plate such that the anode is an insoluble anode. As discussed in greater detail below, the electrodeposition system 100 disclosed herein eliminates the need for a relatively expensive corrosion-resistant anode to be used in order to prevent anode and/or plating solution degradation.

For purposes of this disclosure, a soluble anode refers to an anode having an outer metal surface that is exposed to the plating solution and that is soluble in the particular plating solution particularly during an active plating period. An insoluble anode refers to an anode having an outer metal surface that is exposed to a plating solution and that is insoluble in (i.e., can not be dissolved in) the plating solution particularly during an active plating period. However, as discussed above, depending upon the material used such an insoluble anode may be subject to corrosion particularly during a non-plating period (i.e., during an idle period, when the anode is not polarized relative to a cathode). A corrosion-resistant anode refers to an anode having at least an outer metal surface that is exposed to a plating solution, that is insoluble in the plating solution during an active plating period and that is also resistant to corrosion by the particular plating solution during a non-plating period. Thus, for example, in a SnAg electrodeposition system using the above-described MSA-based plating solution, the first conductive plate 124 can comprise a soluble metal plate and, particularly, a tin (Sn) plate such that it is a soluble anode because Sn, when exposed to an MSA-based plating solution during an active plating period is soluble in that MSA-based solution. Alternatively, the first conductive plate 124 can comprise an insoluble metal plate, for example, a platinum (Pt) catalyst-coated titanium (Ti) metal plate. Such a platinum (Pt) catalyst-coated titanium (Ti) metal plate is an insoluble anode because, when Ti is exposed to an MSA-based plating solution during an active plating period, stabilized titanium oxide is formed (i.e., titanium oxide in a stabilized state is formed) and titanium oxide is insoluble in (i.e., can not be dissolved in) the MSA-based solution.

In any case, the capacitor 127 can further comprise a dielectric layer 125 and a second conductive plate 126 stacked on the backside 129 of the first conductive plate 124. That is, the capacitor 127 can comprise a second conductive plate 126 adjacent to the backside 129 of the first conductive plate 124 and a dielectric layer 125 (or more than one dielectric layer) positioned between and immediately adjacent to both the first conductive plate 124 and the second conductive plate 126. Each dielectric layer 125 can comprise a dielectric (i.e., insulative) material (e.g., plastic, glass, porcelain, or any other suitable dielectric material). The second conductive plate 126 can comprise a metal or metal alloy plate. For example, the second conductive plate 126 can comprise a plate of aluminum (Al), copper (Cu), titanium (Ti), platinum (Pt), tin (Sn), silver (Ag), nickel (Ni), cobalt (Co), lead (Pb), or any alloy thereof.

The first holder 121 can comprise an insulative material (e.g., plastic, glass, or porcelain). The first holder 121 can be submerged within (e.g., can be adapted to be submerged within, can be configured to be submerged within, etc.) the plating solution 102. The first holder 121 can further hold (e.g., can be adapted to hold, can be configured to hold, etc.) the capacitor 127. Specifically, the first holder 121 can hold the capacitor 127 such that only a surface of the first conductive plate 124 on the frontside 128 is exposed. For example, the first holder 121 can have an opening 122 and the capacitor 127 can be positioned within the first holder 121 immediately adjacent to the opening 122 such that a surface of the first conductive plate 124 on the frontside 128 is exposed to the plating solution 102. A seal 123 (e.g., a rubber or polymer seal) can border the edge of the opening 122 such that it is positioned between and immediately adjacent to both the first conductive plate 124 and the first holder 121 so as to ensure that the only portion of the capacitor 127 exposed to the plating solution 102 is the surface of the first conductive plate 124 on the frontside 128 immediately adjacent to the opening 122. That is, the seal 123 can prevent all other portions of the capacitor 127, including the dielectric layer 125 and second conductive plate 126, from being exposed to the plating solution 102 (i.e., can protect the dielectric layer 125 and second conductive plate 126 from exposure to the plating solution 102).

Figure 2:
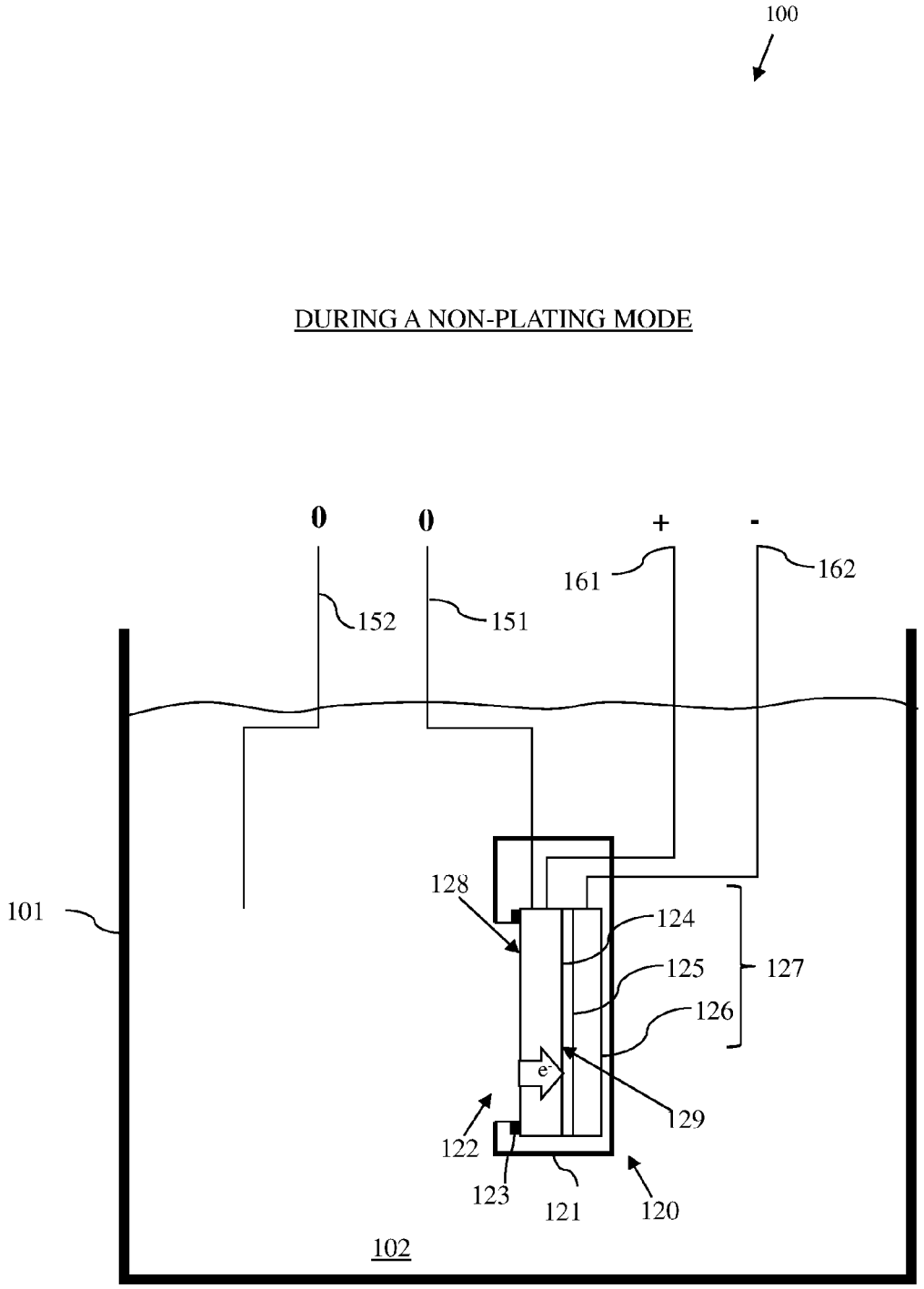
FIG. 2 is a schematic diagram illustrating the electrodeposition system of FIG. 1 operating in a non-plating mode.

The first power source 160 can comprise a first positive terminal 161 electrically connected to the first conductive plate 124 (i.e., the anode) and a first negative terminal 162 electrically connected to the second conductive plate 126. During a non-plating mode (as illustrated in FIG. 2) and, particularly, when the surface of the first conductive plate 124 (i.e., the anode) on the frontside 128 is exposed to the plating solution 102 and is not polarized relative to a cathode for plating purposes, the first power source 160 can supply a first operating current to the capacitor 127 in order to polarize the first conductive plate 124 (i.e., the anode) relative to the second conductive plate 126. Such polarization pulls electrons away from the frontside 128 of the first conductive plate 124 toward the backside 129 and, thereby prevents anode and/or plating solution degradation. It should be noted that the first conductive plate 124, the dielectric layer 125 and the second conductive plate 126 should all be approximately equal in length and height (although not necessarily in thickness) so that the charge across the surface of the frontside 128 of the first conductive plate 124, which is exposed to the plating solution 102 during the non-plating period, remains essentially uniform.

As discussed above, in a prior art SnAg electrodeposition system using a soluble Sn anode and an MSA-based plating solution with tin ions ($Sn^{2+}$ ions) and silver ions ($Ag^{+}$ ions) dissolved therein, during a non-plating period (e.g., when a cathode is disconnected from a power source and removed from the MSA-based plating solution and the soluble Sn anode remains exposed to the MSA-based plating solution), a double layer can be created at that surface of the soluble Sn anode and can cause Ag+ ions in the MSA-based plating solution to plate onto the Sn anode (i.e., can cause unwanted removal of the Ag+ ions from the plating solution), thereby degrading the composition of the plating solution and, particularly, reducing the Ag composition in the plating solution. In a SnAg electrodeposition system as disclosed herein, the first conductive plate 124 can comprise a soluble metal plate and, particularly, a tin (Sn) plate such that it is a soluble Sn anode and the plating solution 102 can similarly comprise an MSA-based plating solution with tin ions ($Sn^{2+}$ ions) and silver ions ($Ag^{+}$ ions) dissolved therein. However, in this case, during a non-plating mode and, particularly, when the surface on the frontside 128 of the first conductive plate 124 (i.e., of the soluble Sn anode) is exposed to the plating solution 102 and when the first conductive plate 124 is not polarized relative to a cathode for plating purposes, the first power source 160 can supply a first operating current to the capacitor 127 in order to polarize the first conductive plate 124 relative to the second conductive plate 126. Such polarization pulls electrons away from the frontside 128 of the first conductive plate 124 toward the backside 129 so as to prevent formation of the double layer and, thereby prevents Ag+ ions in the MSA-based plating solution from plating out onto the first conductive plate 124 (i.e., onto the soluble Sn anode). The first operating current used should be predetermined so that the potential difference between the first conductive plate 124 and the second conductive plate 126 is sufficient to ensure that the $Ag^{+}$ ions do not plate out onto the first conductive plate 124. This first operating current can, for example, be determined using a systematic approach to find an operating current that is approximately 0.1V above (i.e., more positive than) the potential need to suppress the reaction of interest (i.e., unwanted deposition of $Ag^{+}$ ions onto the first conductive plate 124). It should, however, be noted that as a result of such polarization Sn from the soluble Sn anode may continue to slowly dissolve into the plating solution 102. However, the benefits of preventing Ag from plating onto the anode outweigh any costs associated with increased Sn in the plating solution.

Also as discussed above, in a prior art SnAg electrodeposition system using an insoluble anode, such as a platinum (Pt) catalyst-coated titanium (Ti) anode, and an MSA-based plating solution with tin ions ($Sn^{2+}$ ions) and silver ions ($Ag^{+}$ ions) dissolved therein, the plating process will slowly degrade the Pt catalyst coating over time, thereby exposing Ti on the surface of the anode. During a non-plating period (e.g., when a cathode is disconnected from a power source and removed from the MSA-based plating solution and the platinum (Pt) catalyst-coated titanium (Ti) anode remains exposed to the MSA-based plating solution), a double layer can be created at the exposed Ti surface of the anode causing titanium ions ($Ti^{4+}$ ions) to dissolve into the MSA-based plating solution and tin ions ($Sn^{2+}$ ions) from the MSA-based plating solution to deposit onto the anode, thereby forming a $SnO_2$/Pt catalyst-coated Ti anode, which can readily degrade organics in the MSA-based plating solution and lead to skip plating. In a SnAg electrodeposition system as disclosed herein, the first conductive plate 124 can comprise an insoluble metal plate, such as a platinum (Pt) catalyst-coated titanium (Ti) plate, and the plating solution 102 can similarly comprise an MSA-based plating solution with tin ions ($Sn^{2+}$ ions) and silver ions ($Ag^{+}$ ions) dissolved therein. However, in this case, during a non-plating mode and, particularly, when the surface on the frontside 128 of the first conductive plate 124 (i.e., of the insoluble platinum (Pt) catalyst-coated titanium (Ti) anode) is exposed to the plating solution 102 and when the first conductive plate 124 is not polarized relative to a cathode for plating purposes, the first power source 160 can supply a first operating current to the capacitor 127 in order to polarize the first conductive plate 124 relative to the second conductive plate 126. Such polarization pulls electrons away from the frontside 128 of the first conductive plate 124 toward the backside 129 and, thereby prevents titanium ions ($Ti^{4+}$ ions) from any exposed Ti surface (e.g., as a result of corrosion) from dissolving into the MSA-based plating solution and also prevents tin ions ($Sn^{2+}$ ions) from the MSA-based plating solution from depositing onto the anode. This first operating current can, for example, be determined using a systematic approach to find an operating current that is approximately 0.1V above (i.e., more positive than) the potential need to suppress the reaction of interest (i.e., unwanted dissolving of titanium ions ($Ti^{4+}$ ions) into the MSA-based plating solution and unwanted deposition of tin ions ($Sn^{2+}$ ions) onto the anode). It should be noted that, depending upon the first operating current and, particularly, the potential difference between the first conductive plate 124 (i.e., the insoluble platinum (Pt) catalyst-coated titanium (Ti) anode) and the second conductive plate 126 as well as the composition of the plating solution used, such polarization can result in no reaction at all or in hydrogen (H+) (i.e., an acid) being dissolved in the plating solution 102 and/or organics being removed from the plating solution 102.

The cathode assembly 110 can be removably placed in the plating solution 102 in the container 101. The cathode assembly 110 can comprise a second holder 111 comprising, for example, an insulative material (e.g., plastic, glass, porcelain or any other suitable insulative material). The second holder 111 can be submerged within (e.g., can be adapted to be submerged within, can be configured to be submerged within, etc.) the plating solution 102 and can further hold (e.g., can be adapted to hold, can be configured to hold, etc.) a workpiece 112 (i.e., a cathode) such that the workpiece 112 is exposed to the plating solution 102.

Figure 3:
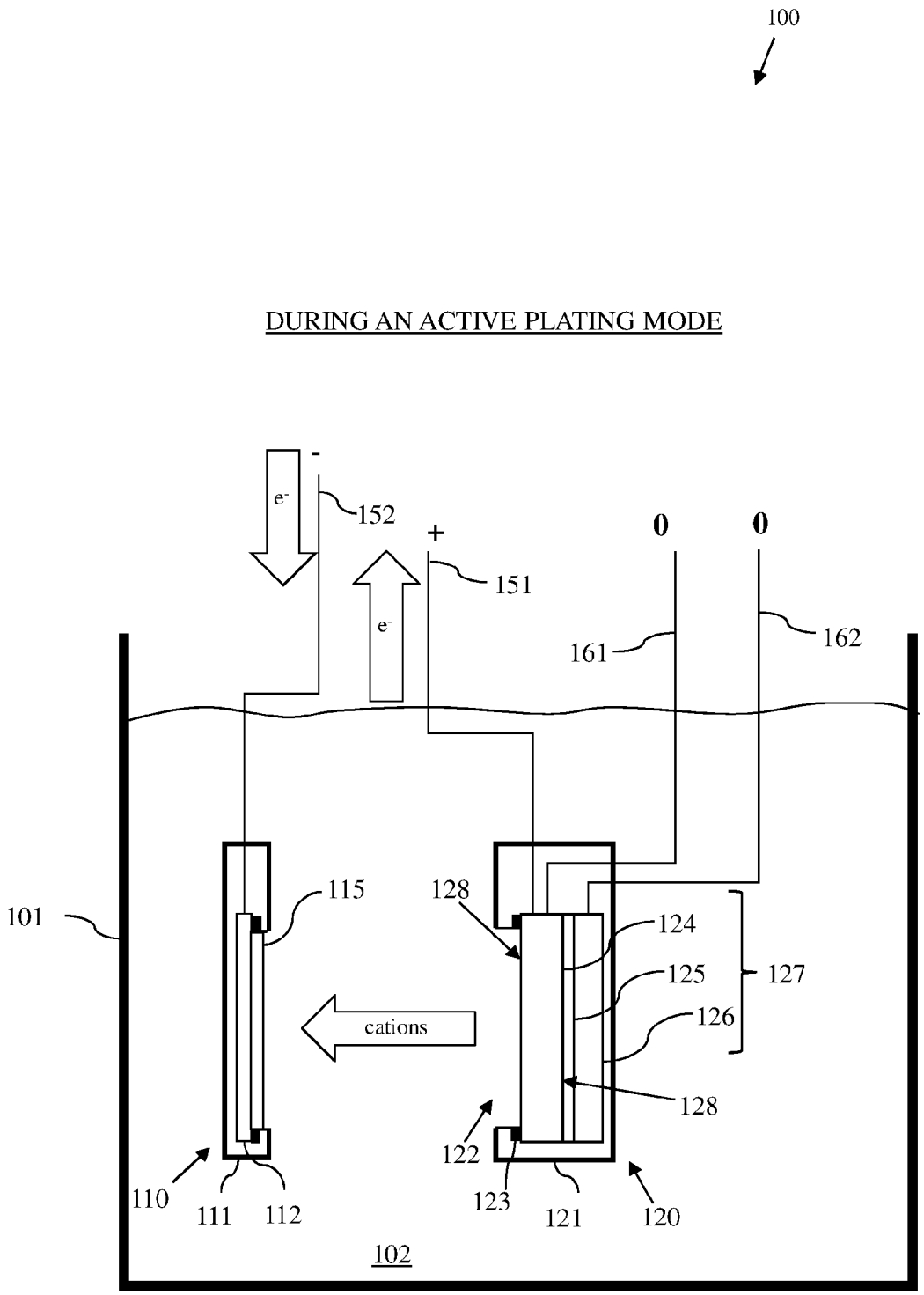
FIG. 3 is a schematic diagram illustrating the electrodeposition system of FIG. 1 operating in an active plating mode.

The second power source 150 can be different from the first power source 160 and can comprise a second positive terminal 151 electrically connected to the first conductive plate 124 (i.e., the anode) and a second negative terminal 152 electrically connected to the workpiece 112 (i.e., the cathode), thereby forming an electric circuit. During an active plating mode, as illustrated in FIG. 3, the second power source 150 can supply a second operating current to the electric circuit in order to polarize the first conductive plate 124 (i.e., the anode) relative to the workpiece 112 (i.e., the cathode). Such polarization causes cations and, particularly, metal ions dissolved in the plating solution 102 to plate out, forming a plated layer 115 on the workpiece 112. For example, in a SnAg electrodeposition system 100 as disclosed herein using an MSA-based plating solution 102 with tin ions ($Sn^{2+}$ ions) and silver ions ($Ag^{+}$ ions) dissolved therein, the second operating current can be predetermined so that the resulting potential difference between the first conductive plate 124 (i.e., the anode) and the workpiece 112 (i.e., the cathode) is at or above the activation overpotential for tin ions ($Sn^{2+}$ ions) to dissolve in the MSA-based plating solution 102 from a soluble Sn anode (if applicable) and also at or above the activation overpotentials for both $Sn^{2+}$ ions and Ag+ ions in the MSA-based plating solution 102 to plate out as a SnAg plated layer 115 on the workpiece 112. In an exemplary SnAg electrodeposition system 100, this potential difference can be at least 0.9 volts and the optimal potential difference (e.g., to ensure uniform plating of the SnAg plated layer 115) is between 1 and 5 volts. The potential difference required between the first conductive plate 124 (i.e., the anode) and the workpiece 112 (i.e., the cathode) to form a plated layer 115 (e.g., a SnAg plated layer) on the workpiece 112 will typically be larger than the potential difference required between the first conductive plate 124 (i.e., the anode) and the second conductive plate 126 in order to prevent anode and/or plating solution degradation, as described above. Thus, the second operating current provided to the electric circuit by the second power source 150 will be relatively high as compared to the first operating current provided to the capacitor 127 by the first power source 160 (i.e., the first operating current will be less than the second operating current).

It should be noted that the first power source 160 and the second power source 150 can be operated manually (e.g., by a user). That is, during a non-plating mode, and particularly, when the cathode assembly 110 with the workpiece 112 is not in the plating solution 102 (i.e., has not been placed in or has been removed from the plating solution 102) and the anode assembly 120 is in the plating solution 102 such that the frontside 128 of the first conductive plate 124 is exposed to that plating solution 102, a user can turn on the first power source 160 and turn off the second power source 150 in order to operate the electrodeposition system 100 in the non-plating mode, thereby polarizing the first conductive plate 124 relative to the second conductive plate 126 and preventing degradation of the anode and/or plating solution. Furthermore, during an active plating mode, and particularly, when the cathode assembly 110 and the anode assembly 120 are both in the plating solution 102 such that the workpiece 112 and the frontside 128 of the first conductive plate 124 are each exposed to the plating solution 102, a user can turn on the second power source 150 and turn off the first power source 160 in order to operate the electrodeposition system 100 in the active plating mode, thereby polarizing the first conductive plate 124 (i.e., the anode) relative to the workpiece 112 (i.e., the cathode), leaving the second conductive plate 126 uncharged, and depositing a plated layer 115 on the workpiece 112.

Alternatively, the electrodeposition system 100 can further comprise a controller 170 operably connected to the first power source 160 and the second power source 150. Based on sensor 175 or other inputs (e.g., user inputs) indicating whether the cathode assembly 110 with the workpiece 112 and/or the anode assembly 120 with the capacitor 127 are within the plating solution 102 in the container 101, the controller 170 can automatically and selectively operate (e.g., can be adapted to automatically and selectively operate, can be configured to automatically and selectively operate, can execute a program of instructions to automatically and selectively operate, etc.) the electrodeposition system 100 in one of a non-plating mode and an active plating mode. That is, during a non-plating mode, and particularly, when sensor 175 or other inputs (e.g., user inputs) indicate that the cathode assembly 110 with the workpiece 112 is not in the plating solution 102 and the anode assembly 120 is in the plating solution 102 such that the frontside 128 of the first conductive plate 124 is exposed to the plating solution 102, the controller 170 can automatically and selectively cause the first power source 160 to turn on and the second power source 150 to turn off in order to operate the electrodeposition system 100 in the non-plating mode, thereby polarizing the first conductive plate 124 relative to the second conductive plate 126 and preventing degradation of the anode and/or plating solution. Furthermore, during an active plating mode, and particularly, when sensor 175 or other inputs (e.g., user inputs) indicate that the cathode assembly 110 and the anode assembly 120 are both in the plating solution 102 such that the workpiece 112 and the frontside 128 of the first conductive plate 124 are each exposed to the plating solution 102, the controller 170 can automatically and selectively cause the second power source 150 to turn on and the first power source 160 to turn off in order to operate the electrodeposition system 100 in the active plating mode, thereby polarizing the first conductive plate 124 (i.e., the anode) relative to the workpiece 112 (i.e., the cathode), leaving the second conductive plate 126 uncharged, and depositing a plated layer 115 on the workpiece 112.

As mentioned above, the electrodeposition system 100 could be used to deposit a SnAg plated layer 115 on a workpiece 112; however, alternatively, the electrodeposition system 100 could be used to deposit any other type of plated layer 115 on a workpiece 112 with similar benefits provided by the anode assembly 120 and first power source 160. For example, in another exemplary electrodeposition system 100, the first conductive plate 124 (i.e., the anode) of the capacitor 127 in the anode assembly 120 can comprise a copper (Cu) plate. This Cu plate can be soluble (i.e., can be a soluble Cu anode) so as to replenish copper ions ($Cu^{2+}$ ions) in the plating solution 102 during an active plating mode, which is performed in order to deposit a Cu plated layer 115 on a workpiece 112. Furthermore, during a non-plating mode, the first conductive plate 124 (i.e., the soluble Cu anode) can be polarized relative to the second conductive plate 126 in order to ensure that any copper ions dissolved in the plating solution 102 from the soluble Cu anode during the non-plating mode are $Cu^{2+}$ ions as opposed to $Cu^{+}$ ions, which are undesirable for Cu deposition of wiring and/or interconnects on integrated circuit chips.

Figure 4:
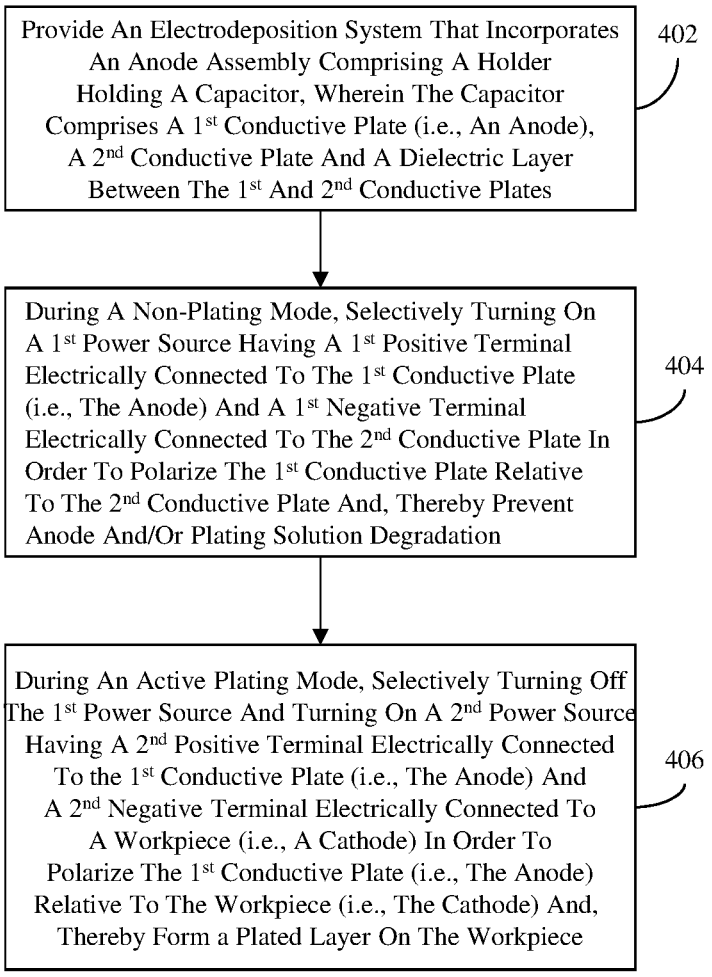
FIG. 4 is a flow diagram illustrating an electrodeposition method.

Referring to FIG. 4, also disclosed herein is an electrodeposition method. For purposes of illustration, this electrodeposition method is described below as a tin-silver (SnAg) electrodeposition method for use in depositing a SnAg plated layer on a workpiece (i.e., an article or object to be plated). Those skilled in the art will recognize that SnAg plated layers are often used as solder for controlled collapsed chip connections (i.e., C4 connections) on integrated circuit chips. It should, however, be understood that the electrodeposition method could, alternatively, be used to deposit any other type of plated layer on a workpiece. That is, the electrodeposition method could alternatively be used to deposit a plated layer comprising one or more of a variety of different metals including, but are not limited to, tin (Sn), silver (Ag), nickel (Ni), cobalt (Co), lead (Pb), copper (Cu), palladium (Pd), gold (Au) or their various alloys.

In any case, the electrodeposition method can comprise providing an electrodeposition system 100, as described in detail above and illustrated in FIG. 1 (402).

Specifically, the electrodeposition system 100 provided at process 402 can comprise a container 101 (i.e., a reservoir, a tub, etc.) for containing a plating solution 102. For purposes of this disclosure, a plating solution comprises at least a solvent (e.g., water) and a substance (e.g., an acid or base) that is dissolved in the solvent and that provides ionic conductivity. The plating solution 102 can comprise one or more organic additive(s) (also referred to herein as organics), such as complexers, charge carriers, levelers, brighteners, and/or wetters, dissolved in the solvent. The plating solution 102 can also comprise one or more different types of plating material(s), which are dissolved in the solvent as stabilized metal species (i.e., as metal ions). The metal ions can be dissolved in the plating solution 102 from metal salt(s) or from metal concentrate(s) (which are metal salt(s) previously dissolved in the same solvent used in the plating solution) and/or from soluble anode(s) used during an active plating mode, as discussed in greater detail below. In a SnAg electrodeposition method, this plating solution 102 can comprise, for example, a methyl sulfonic acid (MSA)-based plating solution. Such an MSA-based plating solution can comprise a solvent and, particularly, water. Methyl sulfonic acid (MSA) can be dissolved in the water to provide ionic conductivity. Additionally, one or more organic additive(s) (e.g., complexers, charge carriers, levelers, brighteners and/or wetters), tin ions ($Sn^{2+}$ ions), and silver ions (Ag+ ions) can be dissolved in the water. The $Sn^{2+}$ ions can be dissolved in the water from a tin (Sn) salt or from a tin (Sn) concentrate and/or can be dissolved in the water, during an active plating mode, from a soluble tin (Sn) anode (e.g., if such an anode is used (see detailed discussion below regarding anode composition)). The Ag+ ions can be dissolved in the water from a silver (Ag) salt or a silver (Ag) concentrate (which comprises Ag salt previously dissolved in water or an MSA solution). Alternatively, in a SnAg electrodeposition method, the plating solution 102 can comprise a phosphonate-based plating solution, a pyrophosphate-based plating solution, or any other suitable plating solution.

The electrodeposition system 100 provided at process 402 can further comprise an anode assembly 120, which can be removably placed in the plating solution 102 (e.g., in the MSA-based plating solution) within the container 101 and a first power source 160. This anode assembly 120 can comprise a capacitor 127 and a first holder 121 for holding the capacitor 127 in the plating solution 102 within the container 101. The capacitor 127 can comprise a first conductive plate 124 and, particularly, an anode. The first conductive plate 124 (i.e., the anode) can have a frontside 128 and a backside 129 opposite the frontside 128. This first conductive plate 124 can comprise a soluble metal plate such that the anode is a soluble anode. Alternatively, the first conductive plate 124 can comprise an insoluble metal plate such that the anode is an insoluble anode. For example, in a SnAg electrodeposition method using the above-described MSA-based plating solution, the first conductive plate 124 can comprise a soluble metal plate and, particularly, a tin (Sn) plate such that it is a soluble anode because Sn, when exposed to an MSA-based plating solution during an active plating period is soluble in that MSA-based solution. Alternatively, the first conductive plate 124 can comprise an insoluble metal plate, for example, a platinum (Pt) catalyst-coated titanium (Ti) metal plate. Such a platinum (Pt)

catalyst-coated titanium (Ti) metal plate is an insoluble anode because, when Ti is exposed to an MSA-based plating solution during an active plating period, stabilized titanium oxide is formed (i.e., titanium oxide in a stabilized state is formed) and titanium oxide is insoluble in (i.e., can not be dissolved in) the MSA-based solution. In any case, the capacitor 127 can further comprise a dielectric layer 125 (or more than one dielectric layer) and a second conductive plate 126 stacked on the backside 129 of the first conductive plate 124. That is, the capacitor 127 can comprise a second conductive plate 126 adjacent to the backside 129 of the first conductive plate 124 with the dielectric layer 125 positioned between and immediately adjacent to both the first conductive plate 124 and the second conductive plate 126. Each dielectric layer 125 can comprise a dielectric (i.e., insulative) material (e.g., plastic, glass, porcelain, or any other suitable dielectric material). The second conductive plate 126 can comprise a metal or metal alloy plate. For example, the second conductive plate 126 can comprise a plate of aluminum (Al), copper (Cu), titanium (Ti), platinum (Pt), tin (Sn), silver (Ag), nickel (Ni), cobalt (Co), lead (Pb), or any alloy thereof. The first holder 121 can be submerged within the plating solution 102 and can hold the capacitor 127 such that only a surface of the first conductive plate 124 on the frontside 128 is exposed to the plating solution 102 and such that all other portions of the capacitor 127, including the dielectric layer 125 and second conductive plate 126, are prevented from being exposed to the plating solution 102. The first power source 160 can comprise a first positive terminal 161 electrically connected to the first conductive plate 124 (i.e., the anode) and a first negative terminal 162 electrically connected to the second conductive plate 126.

The electrodeposition method can further comprise, during a non-plating mode and, particularly, when the surface of the first conductive plate 124 (i.e., the anode) on the frontside 128 is exposed to the plating solution 102 and is not polarized relative to a cathode for plating purposes, selectively turning on the first power source 160 in order to supply a first operating current to the capacitor 127, thereby polarizing the first conductive plate 124 (i.e., the anode) relative to the second conductive plate 126 (404, see FIG. 2). Such polarization pulls electrons away from the frontside 128 of the first conductive plate 124 (i.e., the anode) toward the backside 129 of the first conductive plate 124 and, thereby prevents anode and/or plating solution degradation. It should be noted that the first conductive plate 124, the dielectric layer 125 and the second conductive plate 126 should all be approximately equal in length and height (although not necessarily in thickness) so that the charge across the surface of the frontside 128 of the first conductive plate 124, which is exposed to the plating solution 102 during the non-plating period, remains essentially uniform.

As discussed above, in a prior art SnAg electrodeposition method using a soluble Sn anode and an MSA-based plating solution with tin ions ($Sn^{2+}$ ions) and silver ions ($Ag^{+}$ ions) dissolved therein, during a non-plating period (e.g., when a cathode is disconnected from a power source and removed from the MSA-based plating solution and the soluble Sn anode remains exposed to the MSA-based plating solution), a double layer can be created at that surface of the soluble Sn anode and can cause Ag+ ions in the MSA-based plating solution to plate onto the Sn anode (i.e., can cause unwanted removal of the Ag+ ions from the plating solution), thereby degrading the composition of the plating solution and, particularly, reducing the Ag composition in the plating solution. In a SnAg electrodeposition method as disclosed herein, the first conductive plate 124 can comprise a soluble metal plate and, particularly, a tin (Sn) plate such that it is a soluble Sn anode and the plating solution 102 can similarly comprise an MSA-based plating solution with tin ions ($Sn^{2+}$ ions) and silver ions ($Ag^{+}$ ions) dissolved therein. However, in this case, during a non-plating mode at process 404 and, particularly, when the surface on the frontside 128 of the first conductive plate 124 (i.e., of the soluble Sn anode) is exposed to the plating solution 102 and when the first conductive plate 124 is not polarized relative to a cathode for plating purposes, the first power source 160 can be selectively turned on in order to supply a first operating current to the capacitor 127, thereby polarizing the first conductive plate 124 relative to the second conductive plate 126. Such polarization pulls electrons away from the frontside 128 of the first conductive plate 124 toward the backside 129 so as to prevent formation of the double layer and, thereby prevents Ag+ ions in the MSA-based plating solution 102 from plating out onto the first conductive plate 124. The first operating current used should be predetermined so that the potential difference between the first conductive plate 124 and the second conductive plate 126 is sufficient to ensure that the $Ag^{+}$ ions do not plate out onto the first conductive plate 124. This first operating current can, for example, be determined using a systematic approach to find an operating current that is approximately 0.1V above (i.e., more positive than) the potential need to suppress the reaction of interest (i.e., unwanted deposition of $Ag^{+}$ ions onto the first conductive plate 124). It should, however, be noted that as a result of such polarization Sn from the soluble Sn anode may continue to slowly dissolve into the plating solution 102. However, the benefits of preventing Ag from plating onto the anode outweigh any costs associated with increased Sn in the plating solution.

Also as discussed above, in prior art SnAg electrodeposition methods using an insoluble anode, such as a platinum (Pt) catalyst-coated titanium (Ti) anode, and an MSA-based plating solution with tin ions ($Sn^{2+}$ ions) and silver ions ($Ag^{+}$ ions) dissolved therein, the plating process will slowly degrade the Pt catalyst coating over time exposing Ti on the surface of the anode. During a non-plating period (e.g., when a cathode is disconnected from a power source and removed from the MSA-based plating solution and the platinum (Pt) catalyst-coated titanium (Ti) anode remains exposed to the MSA-based plating solution), a double layer can be created at the exposed Ti surface of the anode causing titanium ions ($Ti^{4+}$ ions) to dissolve into the MSA-based plating solution and tin ions ($Sn^{2+}$ ions) from the MSA-based plating solution to deposit onto the anode, thereby forming a $SnO_2$/Pt catalyst-coated Ti anode, which can readily degrade organics in the MSA-based plating solution and lead to skip plating. In a SnAg electrodeposition method as disclosed herein, the first conductive plate 124 can comprise an insoluble metal plate, such as a platinum (Pt) catalyst-coated titanium (Ti) plate such that it is an insoluble Sn anode and the plating solution 102 can similarly comprise an MSA-based plating solution with tin ions ($Sn^{2+}$ ions) and silver ions ($Ag^{+}$ ions) dissolved therein. However, in this case, during a non-plating mode at process 404 and, particularly, when the surface on the frontside 128 of the first conductive plate 124 (i.e., of the insoluble platinum (Pt) catalyst-coated titanium (Ti) anode) is exposed to the plating solution 102 and when the first conductive plate 124 is not polarized relative to a cathode for plating purposes, the first power source 160 can be selectively turned on in order to supply a first operating current to the capacitor 127, thereby polarizing the first conductive plate 124 relative to the second conductive plate 126. Such polarization pulls electrons away from the frontside 128 of the first conductive plate 124 toward the backside 129 and, thereby prevents titanium ions ($Ti^{4+}$ ions) from any exposed Ti surface (e.g., as a result of corrosion) from dissolving into the MSA-based plating solution and, thereby preventing tin ions ($Sn^{2+}$ ions) from the MSA-based plating solution from depositing onto the anode. This first operating current can, for example, be determined using a systematic approach to find an operating current that is approximately 0.1V above (i.e., more positive than) the potential need to suppress the reaction of interest (i.e., unwanted dissolving of titanium ions ($Ti^{4+}$ ions) into the MSA-based plating solution and unwanted deposition of tin ions ($Sn^{2+}$ ions) onto the anode). It should be noted that, depending upon the first operating current and, particularly, the potential difference between the first conductive plate 124 (i.e., the insoluble platinum (Pt) catalyst-coated titanium (Ti) anode) and the second conductive plate 126 as well as the composition of the plating solution used, such polarization can result in no reaction at all or in hydrogen (H+) (i.e., an acid) being dissolved in the plating solution 102 and/or organics being removed from the plating solution 102.

The electrodeposition system 100 provided at process 402 can further comprise a cathode assembly 110, which can be removably placed in the plating solution 102 in the container 101, and a second power source 150, which is different from the first power source 160. The cathode assembly 110 can comprise a second holder 111, which can be submerged within the plating solution 102 and which can further hold a workpiece 112 (i.e., a cathode) such that the workpiece 112 is exposed to the plating solution 102. The second power source 150 can comprise a second positive terminal 151 electrically connected to the first conductive plate 124 (i.e., the anode) and a second negative terminal 152 electrically connected to the workpiece 112 (i.e., the cathode), thereby forming an electric circuit.

The electrodeposition method can further comprise, during an active plating mode, selectively turning off the first power source 160 and selectively turning on the second power source 150 in order to supply a second operating current to the electric circuit, thereby polarizing the first conductive plate 124 (i.e., the anode) relative to the workpiece 112 (i.e., the cathode) (406, see FIG. 3). Such polarization causes cations and, particularly, metal ions dissolved in the plating solution 102 to plate out, forming a plated layer 115 on the workpiece 112. For example, in a SnAg electrodeposition method as disclosed herein using an MSA-based plating solution 102 with tin ions ($Sn^{2+}$ ions) and silver ions ($Ag^{+}$ ions) dissolved therein, the second operating current can be predetermined so that the resulting potential difference between the first conductive plate 124 (i.e., the anode) and the workpiece 112 (i.e., the cathode) is at or above the activation overpotential for tin ions ($Sn^{2+}$ ions) to dissolve in the MSA-based plating solution 102 from a soluble Sn anode (if applicable) and also at or above the activation overpotentials for both $Sn^{2+}$ ions and Ag+ ions in the MSA-based plating solution 102 to plate out as a SnAg plated layer 115 on the workpiece 112. In an exemplary SnAg electrodeposition method, this potential difference can be at least 0.9 volts and the optimal potential difference (e.g., to ensure uniform plating of the SnAg plated layer 115) is between 1 and 5 volts. The potential difference required between the first conductive plate 124 (i.e., the anode) and the workpiece 112 (i.e., the cathode) to form a plated layer 115 (e.g., a SnAg plated layer) on the workpiece 112 at process 406 will typically be larger than the potential difference required between the first conductive plate 124 (i.e., the anode) and the second conductive plate 126 in order to prevent anode and/or plating solution degradation at process 404, as described above. Thus, the second operating current provided to the electric circuit by the second power source 150 will be relatively high as compared to the first operating current provided to the capacitor 127 by the first power source 160 (i.e., the first operating current will be less than the second operating current).

It should be noted that the processes 404-406 can be performed manually (e.g., by a user). Alternatively, these processes 404-406 can be performed automatically and selectively by a controller 170, which is operably connected to the first power source 160 and the second power source 150 and which comprises a processor that can access (e.g., from memory) a program of instructions and can execute that program of instructions in order to perform the process 404-406 based on sensor 175 or other inputs (e.g., user inputs) indicating whether the cathode assembly 110 with the workpiece 112 and/or the anode assembly 120 with the capacitor 127 are within the plating solution 102 in the container 101.

As mentioned above, the electrodeposition method disclosed herein could be used to deposit a SnAg plated layer 115 on a workpiece 112; however, alternatively, the electrodeposition method could be used to deposit any other type of plated layer 115 on a workpiece 112 with similar benefits provided by the anode assembly 120 and the first power source 160. For example, in another exemplary electrodeposition method, the first conductive plate 124 (i.e., the anode) of the capacitor 127 in the anode assembly 120 of the electrodeposition system 100 provided at process 402 can comprise a copper (Cu) plate. This Cu plate can be soluble (i.e., can be a soluble Cu anode) so as to replenish copper ions ($Cu^{2+}$ ions) in the plating solution 102 during active plating at process 406 in order to deposit a Cu plated layer 115 on a workpiece 112. Furthermore, during a non-plating mode at process 404, the first conductive plate 124 (i.e., the soluble Cu anode) can be polarized relative to the second conductive plate 126 in order to ensure that any copper ions dissolved in the plating solution 102 from the soluble Cu anode during the non-plating mode are $Cu^{2+}$ ions as opposed to $Cu^{+}$ ions, which are undesirable for Cu deposition of wiring and/or interconnects on integrated circuit chips.

Also disclosed herein is a computer program product. The computer program product can comprise a computer readable storage medium having program instructions embodied therewith (i.e., stored thereon). The program instructions can be executable by a processor (e.g., by a processor of the controller 170 in the electrodeposition system 100 discussed above) in order to cause the processor to carry out aspects of the present invention and, particularly, to cause the above-described electrodeposition systems to perform the above-described electrodeposition methods.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 5:
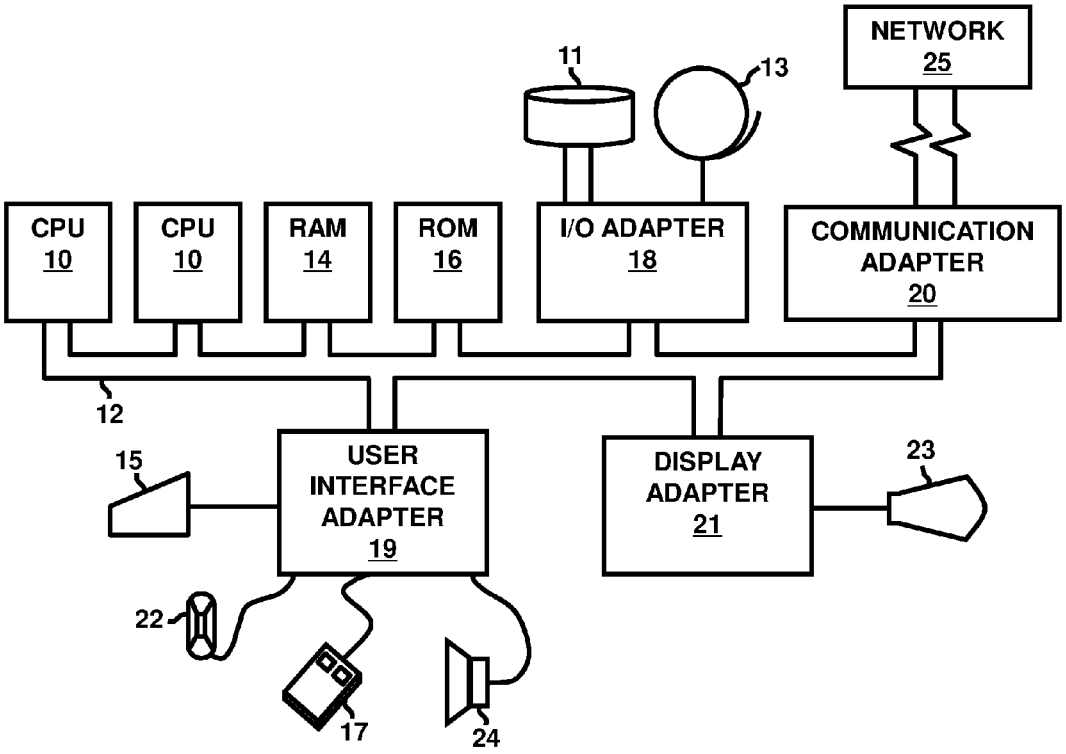
FIG. 5 is a schematic diagram illustrating an exemplary computer system used to implement system and method embodiments disclosed herein.

FIG. 5 depicts a representative hardware environment that can be used to implement the above-described systems, methods, and computer program products. This schematic drawing illustrates a hardware configuration of an information handling/computer system in accordance with the embodiments herein. The system comprises at least one processor or central processing unit (CPU) 10. The CPUs 10 are interconnected via a system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the system. The system can read the inventive instructions on the program storage devices and follow these instructions to execute the methodology of the embodiments herein. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

It should be understood that the terminology used herein is for the purpose of describing the disclosed system and method and is not intended to be limiting. For example, as used herein, the singular forms "a", "an", and "the" are intended to include the plural forms as well, unless the context clearly indicates otherwise. Additionally, as used herein, the terms "comprises" "comprising", "includes" and/or "including" specify the presence of stated features, integers, steps, operations, elements, and/or components, but do not preclude the presence or addition of one or more other features, integers, steps, operations, elements, components, and/or groups thereof. Furthermore, as used herein, terms such as "right", "left", "vertical", "horizontal", "top", "bottom", "upper", "lower", "under", "below", "underlying", "over", "overlying", "parallel", "perpendicular", etc., are intended to describe relative locations as they are oriented and illustrated in the drawings (unless otherwise indicated) and terms such as "touching", "on", "in direct contact", "abutting", "directly adjacent to", etc., are intended to indicate that at least one element physically contacts another element (without other elements separating the described elements). The corresponding structures, materials, acts, and equivalents of all means or step plus function elements in the claims below are intended to include any structure, material, or act for performing the function in combination with other claimed elements as specifically claimed.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Therefore, disclosed above are an electrodeposition system and method that use a novel anode having a backside capacitive element in order to minimize anode and/or plating solution degradation when the anode is exposed to a plating solution during a non-plating period (i.e., during an idle period). Specifically, in the electrodeposition system and method disclosed herein, an anode assembly can comprise a capacitor comprising a first conductive plate (and, particularly, an anode), which has a frontside with a surface exposed to a plating solution and a backside opposite the frontside. The capacitor can further comprise a second conductive plate on the backside of the first conductive plate and a dielectric layer between the first conductive plate and the second conductive plate. During a non-plating mode, a first power source, which has positive and negative terminals electrically connected to the first and second conductive plates, respectively, can be selectively turned on, thereby polarizing the first conductive plate relative to the second conductive plate in order to prevent degradation of the surface of the first conductive plate, which is exposed to the plating solution, and/or to prevent degradation of plating solution. During an active plating mode, the first power source can be selectively turned off and a second power source, which has positive and negative terminals electrically connected to the first conductive plate (i.e., the anode) and a cathode, respectively, can be selectively turned on, thereby polarizing the first conductive plate (i.e., the anode) relative to the cathode in order to deposit a plated layer on a workpiece, which is exposed to the plating solution at the cathode.

What is claimed is:

1. An electrodeposition system comprising:

a container containing a methyl sulfonic acid (MSA) plating solution;

a first holder submerged in said MSA plating solution, said first holder holding a capacitor comprising:

a first conductive plate;

a second conductive plate parallel to said first conductive plate; and a dielectric layer between said first conductive plate and said second conductive plate; wherein said first holder includes a seal allowing only said first conductive plate to be exposed to said MSA plating solution; and, a first power source connected to said first conductive plate and said second conductive plate so as to form a first electric circuit, said first power source supplying a first operating current to said capacitor during a non-plating mode when a surface of said first conductive plate is exposed to said MSA plating solution in said container.

2. The electrodeposition system of claim 1, said first holder comprising:

an opening exposing said surface of said first conductive plate to said MSA plating solution; and, said seal is around said opening so as to prevent exposure of said dielectric layer and said second conductive plate to said MSA plating solution.

3. The electrodeposition system of claim 1, wherein said first conductive plate comprises an anode, said electrodeposition system further comprising:

a second holder submerged in said MSA plating solution, said second holder holding a cathode; and a second power source connected to said anode and said cathode so as to form a second electric circuit, said second power source supplying a second operating current to said second electric circuit during an active plating mode so as to form a plated layer on a workpiece exposed to said MSA plating solution as said cathode.

4. The electrodeposition system of claim 3, said first operating current being less than said second operating current.

5. The electrodeposition system of claim 3, further comprising a controller operably connected to said first power source and said second power source, said controller selectively causing said first power source to turn on and said second power source to turn off in order to operate said electrodeposition system in said non-plating mode, and said controller further selectively causing said second power source to turn on and said first power source to turn off in order to operate said electrodeposition system in said active plating mode.

6. The electrodeposition system of claim 3, said first conductive plate comprising a platinum catalyst-coated titanium plate, said MSA plating solution further comprising tin ions and silver ions dissolved in water, said MSA plating solution corroding platinum and exposing titanium of said platinum catalyst-coated titanium plate, said first operating current preventing said titanium from said platinum catalyst-coated titanium plate from dissolving in said MSA plating solution and further preventing tin from said MSA plating solution from depositing on said surface, and said second operating current causing a tin-silver plated layer to form on said workpiece.

7. The electrodeposition system of claim 1, said first conductive plate comprising any one of a soluble metal plate and an insoluble metal plate.

8. An electrodeposition system comprising:

a container containing a plating solution;

a first holder submerged in said plating solution, said first holder holding a capacitor comprising:

a first conductive plate comprising a tin plate;

a second conductive plate; and a dielectric layer between said first conductive plate and said second conductive plate; wherein said first holder includes a seal allowing only said first conductive plate to be exposed to said plating solution; and, a first power source connected to said first conductive plate and said second conductive plate so as to form a first electric circuit, said first power source supplying a first operating current to said capacitor during a non-plating mode when a surface of said first conductive plate is exposed to said plating solution in said container, said plating solution comprising water and, dissolved in said water, methyl sulfonic acid (MSA), tin ions and silver ions and said first operating current preventing deposition of silver on said surface.

9. The electrodeposition system of claim 8, said first holder comprising:

an opening exposing said surface of said first conductive plate to said plating solution; and, said seal is around said opening so as to prevent exposure of said dielectric layer and said second conductive plate to said plating solution.

10. The electrodeposition system of claim 8, wherein said first conductive plate comprises an anode, said electrodeposition system further comprising:

a second holder submerged in said plating solution, said second holder holding a cathode; and, a second power source connected to said anode and said cathode so as to form a second electric circuit, said second power source supplying a second operating current to said second electric circuit during an active plating mode so as to form a tin-silver plated layer on a workpiece exposed to said plating solution as said cathode.

11. The electrodeposition system of claim 10, said first operating current being less than said second operating current.

12. The electrodeposition system of claim 10, further comprising a controller operably connected to said first power source and said second power source, said controller selectively causing said first power source to turn on and said second power source to turn off in order to operate said electrodeposition system in said non-plating mode, and said controller further selectively causing said second power source to turn on and said first power source to turn off in order to operate said electrodeposition system in said active plating mode.

13. The electrodeposition system of claim 8, said first operating current causing tin from said tin plate to dissolve in said plating solution.

14. A system comprising:

a container comprising a methyl sulfonic acid (MSA) plating solution;

a first assembly submerged in said MSA plating solution, said first assembly comprising:

a capacitor, comprising:

a first conductive plate;

a second conductive plate; and a dielectric layer between said first conductive plate and said second conductive plate, and, a first holder holding said capacitor in said MSA plating solution, said first holder having an opening exposing a surface of said first conductive plate to said MSA plating solution and a seal around said opening preventing exposure of said dielectric layer and said second conductive plate to said MSA plating solution; and a first power source connected to said first conductive plate and said second conductive plate of said first assembly so as to form a first electric circuit, said first power source supplying a first operating current to said first electric circuit during a non-plating mode when said surface is exposed to said MSA plating solution.

15. The system of claim 14, wherein said first conductive plate comprises an anode, said system further comprising:

a second holder submerged in said MSA plating solution, said second holder holding a second assembly comprising a cathode; and a second power source connected to said first assembly and said second assembly so as to form a second electric circuit wherein said second power source is connected to said first conductive plate of said first assembly; and, said second power source is connected to said cathode of said second assembly, said second power source supplying a second operating current to said second electric circuit formed by said cathode and said anode during an active plating mode producing a plated layer on a workpiece exposed to said MSA plating solution as said cathode.

16. The system of claim 15, said first operating current being less than said second operating current.

17. The system of claim 15, further comprising a controller operably connected to said first power source and said second power source, said controller selectively causing said first power source to turn on and said second power source to turn off while operating said system in said non-plating mode, and said controller further selectively causing said second power source to turn on and said first power source to turn off while operating said system in said active plating mode.

18. The system of claim 15, said first conductive plate comprising a platinum catalyst-coated titanium plate, said MSA plating solution further comprising tin ions, and silver ions dissolved in water, said MSA plating solution corroding platinum and exposing titanium of said platinum catalyst-coated titanium plate, said first operating current preventing said titanium from said platinum catalyst-coated titanium plate from dissolving in said MSA plating solution and further preventing tin from said MSA plating solution from depositing on said surface, and said second operating current causing a tin-silver plated layer to form on said workpiece.

19. The system of claim 14, said first conductive plate comprising any one of a soluble metal plate and an insoluble metal plate.

* * * * *